US009879558B2

(12) United States Patent
Rogers et al.

(10) Patent No.: US 9,879,558 B2
(45) Date of Patent: Jan. 30, 2018

(54) LOW LEAKAGE MULTI-DIRECTIONAL INTERFACE FOR A GAS TURBINE ENGINE

(71) Applicant: UNITED TECHNOLOGIES CORPORATION, Hartford, CT (US)

(72) Inventors: Mark J Rogers, Kennebunk, ME (US); Mark Broomer, Boston, MA (US); Craig R. McGarrah, Southington, CT (US); Timothy M Davis, Kennebunk, ME (US); Anthony B Swift, North Waterboro, ME (US); Russell E Keene, Arundel, ME (US); Carson A. Roy Thill, South Berwick, ME (US); Timothy A. Dunbar, Limington, ME (US)

(73) Assignee: United Technologies Corporation, Farmington, CT (US)

( * ) Notice: Subject to any disclaimer, the term of this patent is extended or adjusted under 35 U.S.C. 154(b) by 241 days.

(21) Appl. No.: 14/766,469

(22) PCT Filed: Feb. 5, 2014

(86) PCT No.: PCT/US2014/014811

§ 371 (c)(1),
(2) Date: Aug. 7, 2015

(87) PCT Pub. No.: WO2014/123965

PCT Pub. Date: Aug. 14, 2014

(65) Prior Publication Data

US 2016/0010482 A1 Jan. 14, 2016

Related U.S. Application Data

(60) Provisional application No. 61/762,140, filed on Feb. 7, 2013.

(51) Int. Cl.
*F01D 11/08* (2006.01)
*F01D 25/24* (2006.01)

(52) U.S. Cl.
CPC ..... *F01D 11/08* (2013.01); *F01D 25/246* (2013.01); *F05D 2220/32* (2013.01);
(Continued)

(58) Field of Classification Search
CPC .. F01D 11/08; F05D 2220/32; F05D 2230/60; F05D 2240/55; F05D 2240/10; F05D 2240/20
See application file for complete search history.

(56) References Cited

U.S. PATENT DOCUMENTS 4,309,145 A * 1/1982 Viola ..... F01D 11/025 415/173.7
4,662,658 A * 5/1987 Holowach ..... F02K 1/386 285/148.26

(Continued)

*Primary Examiner* — Mark Laurenzi
*Assistant Examiner* — Shafiq Mian
(74) *Attorney, Agent, or Firm* — Bachman & LaPointe, P.C.

(57) ABSTRACT

An interface within a gas turbine engine includes a multiple of segmented components, each with a segment flange with a multiple of apertures, at least one of the multiple of apertures a first slot aperture. A full ring component with a ring flange that defines a multiple ring of apertures, at least one of the multiple of ring apertures a second slot aperture, the second slot aperture transverse to the first slot aperture.

20 Claims, 4 Drawing Sheets

(52) U.S. Cl.
CPC ..... *F05D 2230/60* (2013.01); *F05D 2240/10* (2013.01); *F05D 2240/20* (2013.01); *F05D 2240/55* (2013.01); *F05D 2250/14* (2013.01)

(56) References Cited

U.S. PATENT DOCUMENTS

| | | | | |
|---|---|---|---|---|
| 5,092,737 | A * | 3/1992 | Lau | F01D 11/18 415/12 |
| 6,146,091 | A * | 11/2000 | Watanabe | F01D 9/04 415/111 |
| 6,612,809 | B2 * | 9/2003 | Czachor | F01D 11/005 415/189 |
| 6,733,233 | B2 * | 5/2004 | Jasklowski | F01D 11/025 415/135 |
| 6,877,952 | B2 * | 4/2005 | Wilson | F01D 11/18 415/136 |
| 7,520,715 | B2 * | 4/2009 | Durocher | F01D 9/04 415/116 |
| 8,684,680 | B2 * | 4/2014 | Martin | F01D 11/08 415/173.1 |
| 8,740,551 | B2 * | 6/2014 | Di Paola | F01D 9/04 415/116 |
| 2003/0099542 | A1 | 5/2003 | Czachor et al. | |
| 2004/0062640 | A1 | 4/2004 | Darkins, Jr. et al. | |
| 2004/0071548 | A1 | 4/2004 | Wilson, Jr. | |
| 2007/0020088 | A1 * | 1/2007 | Durocher | F01D 11/24 415/115 |
| 2009/0033037 | A1 * | 2/2009 | Varanasi | F01D 11/005 277/355 |
| 2010/0104426 | A1 | 4/2010 | Keller et al. | |
| 2011/0044801 | A1 | 2/2011 | Di Paola et al. | |
| 2012/0275898 | A1 * | 11/2012 | McCaffrey | F01D 11/18 415/1 |

* cited by examiner

LOW LEAKAGE MULTI-DIRECTIONAL INTERFACE FOR A GAS TURBINE ENGINE

This application claims priority to U.S. Patent Appln. No. 61/762,140 filed Feb. 7, 2013.

BACKGROUND

The present disclosure relates to a gas turbine engine and, more particularly, to an interface therefor.

Gas turbine engines, such as those that power modern commercial and military aircraft, generally include a compressor section to pressurize an airflow, a combustor section to burn a hydrocarbon fuel in the presence of the pressurized air, and a turbine section to extract energy from the resultant combustion gases.

A Blade Outer Air Seal (BOAS) is located circumferentially about each turbine rotor in the turbine section. The BOAS operates to seal multiple plenums in a high temperature environment. The radial position of the BOAS is also closely controlled to provide an effective seal with the rotor blades that extend from the turbine rotor.

SUMMARY

An interface within a gas turbine engine according to one disclosed non-limiting embodiment of the present disclosure includes a multiple of segmented components, each with a segment flange with a multiple of segment apertures, at least one of the multiple of segment apertures includes a first slot aperture; and a full ring component with a ring flange that defines a multiple of ring apertures, at least one of the multiple of ring apertures includes a second slot aperture, the second slot aperture transverse to the first slot aperture.

According to another disclosed non-limiting embodiment of the present disclosure wherein the second slot aperture is perpendicular to the first slot aperture.

A further embodiment of the present disclosure includes wherein the first slot aperture is circumferentially oriented.

A further embodiment of the present disclosure includes wherein the second slot aperture is radially oriented.

A further embodiment of the present disclosure includes wherein the first slot aperture is circumferentially oriented and the second slot aperture is radially oriented.

A further embodiment of the present disclosure includes wherein each of the multiple of segmented components are Blade Outer Air Seal (BOAS) segments.

A further embodiment of the present disclosure includes wherein the full ring component is a full ring seal support.

A further embodiment of the present disclosure includes wherein comprising a case flange adjacent to the segment flange of each of the multiple of segmented components.

In the alternative or additionally thereto, the foregoing embodiment includes a multiple of fastener assemblies mounted through the case flange, the multiple of segment apertures and the multiple of ring apertures.

In the alternative or additionally thereto, the foregoing embodiment includes wherein each of the multiple of fastener assemblies include a flanged bushing that abuts the case flange and extends through the ring flange and the segment flange.

A Blade Outer Air Seal (BOAS) assembly within a gas turbine engine according to another disclosed non-limiting embodiment of the present disclosure includes a multiple of Blade Outer Air Seal (BOAS) segments, each with a segment flange with a multiple of segment apertures, at least one of the multiple of segment apertures includes a first slot aperture a full ring seal support with a ring flange that defines a multiple of ring apertures, at least one of the multiple of ring apertures includes a second slot aperture, the second slot aperture transverse to the first slot aperture.

A further embodiment of any of the foregoing embodiments of the present disclosure includes wherein the multiple of segment apertures includes a circular aperture.

In the alternative or additionally thereto, the foregoing embodiment includes wherein the multiple of segment apertures defines a slot aperture, circular aperture, slot aperture sequence.

In the alternative or additionally thereto, the foregoing embodiment includes wherein the circular aperture is circumferentially centrally located in the segment flange.

A further embodiment of any of the foregoing embodiments of the present disclosure includes wherein the first slot aperture is circumferentially oriented and the second slot aperture is radially oriented.

A further embodiment of any of the foregoing embodiments of the present disclosure includes a case flange adjacent to the segment flange of each of the multiple of segmented components.

In the alternative or additionally thereto, the foregoing embodiment includes a multiple of fastener assemblies mounted through the case flange, the multiple of segment apertures and the multiple of ring apertures.

In the alternative or additionally thereto, the foregoing embodiment includes wherein each of the multiple of fastener assemblies include a flanged bushing that abuts the case flange and extends through the ring flange and the segment flange.

A method of mounting a Blade Outer Air Seal (BOAS) segment within a gas turbine engine according to another disclosed non-limiting embodiment of the present disclosure includes mounting a fastener assembly through a first slot aperture in a segment flange of a Blade Outer Air Seal (BOAS) segment, the first slot aperture transverse to a second slot aperture in a ring flange of a full ring seal support.

A further embodiment of any of the foregoing embodiments of the present disclosure includes locating a flanged bushing of the fastener assembly through the first slot aperture and the second slot aperture to abut a case flange.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
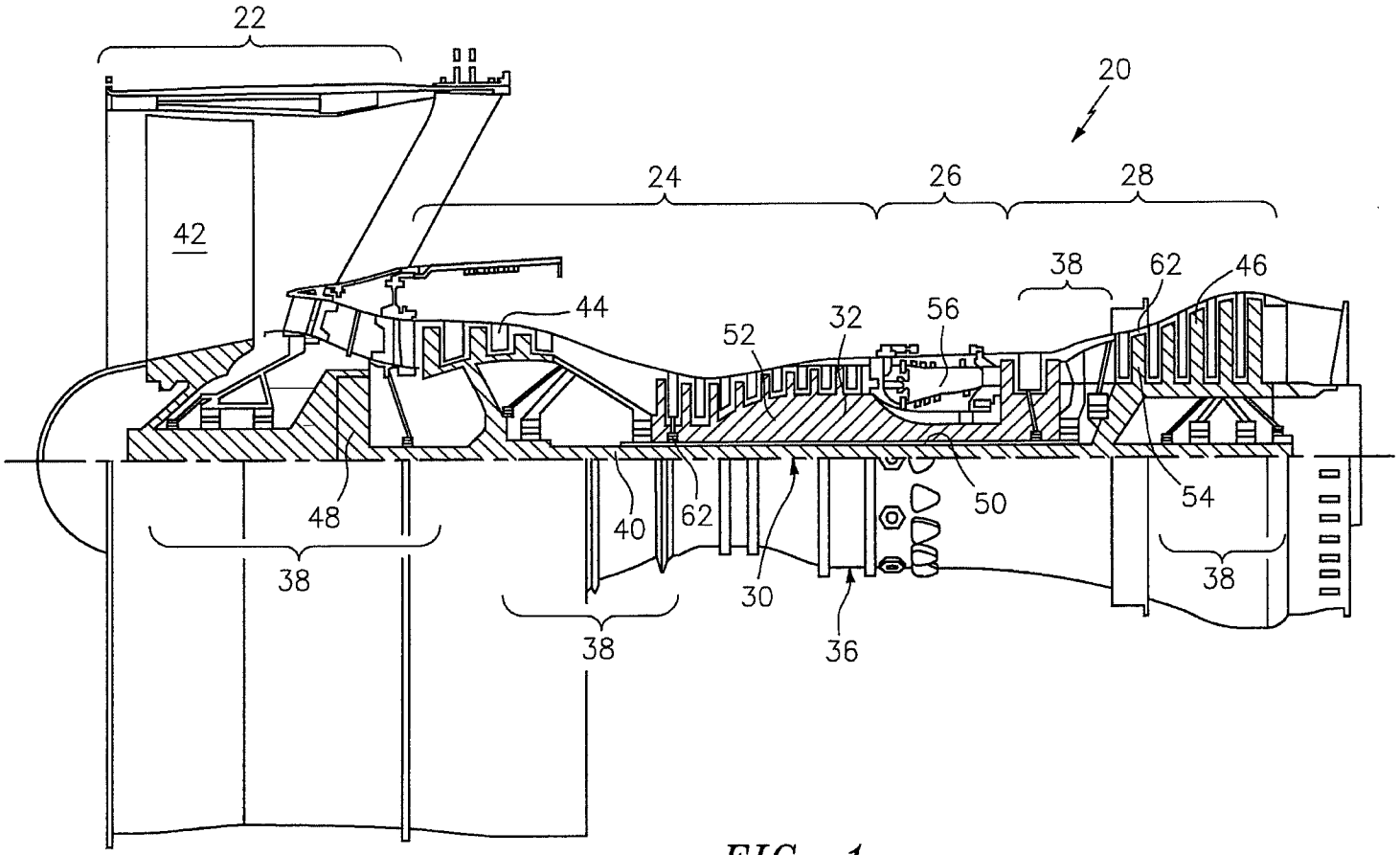
FIG. 1 is a schematic cross-section of an example gas turbine engine architecture.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engine architectures might include an augmentor section, an exhaust duct section and a nozzle system (not shown) among other systems or features. The fan section 22 drives air along a bypass flowpath while the compressor section 24 drives air along a core flowpath for compression and communication into the combustor section 26 then expansion thru the turbine section 28. Although depicted as a turbofan in the disclosed non-limiting embodiment, it should be understood that the concepts described herein are not limited to use with turbofans as the teachings may be applied to other types of turbine engines such as a low bypass augmented turbofan, turbojets, turboshafts, and three-spool (plus fan) turbofans wherein an intermediate spool includes an intermediate pressure compressor ("IPC") between a Low Pressure Compressor ("LPC") and a High Pressure Compressor ("HPC"), and an intermediate pressure turbine ("IPT") between the high pressure turbine ("HPT") and the Low pressure Turbine ("LPT").

The engine 20 generally includes a low spool 30 and a high spool 32 mounted for rotation about an engine central longitudinal axis A relative to an engine case structure 36 via several bearing compartments 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or thru a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the HPC 52 and the HPT 54. The inner shaft 40 and the outer shaft 50 are concentric and rotate about the engine central longitudinal axis A which is collinear with their longitudinal axes.

Core airflow is compressed by the LPC 44 then the HPC 52, mixed with fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by the bearing compartments 38. It should be understood that various bearing compartments 38 at various locations may alternatively or additionally be provided.

In one example, the gas turbine engine 20 is a high-bypass geared aircraft engine with a bypass ratio greater than about six (6:1). The geared architecture 48 can include an epicyclic gear train, such as a planetary gear system or other gear system. The example epicyclic gear train has a gear reduction ratio of greater than about 2.3:1, and in another example is greater than about 2.5:1. The geared turbofan enables operation of the low spool 30 at higher speeds which can increase the operational efficiency of the LPC 44 and LPT 46 to render increased pressure in a relatively few number of stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans, where the rotational speed of the fan 42 is the same (1:1) of the LPC 44.

In one example, a significant amount of thrust is provided by the bypass flow path due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The relatively low Fan Pressure Ratio according to one example gas turbine engine 20 is less than 1.45. Low Corrected Fan Tip Speed is the actual fan tip speed divided by an industry standard temperature correction of $(\text{"T"}/518.7)^{0.5}$ in which "T" represents the ambient temperature in degrees Rankine. The Low Corrected Fan Tip Speed according to one example gas turbine engine 20 is less than about 1150 fps (351 m/s).

Figure 2:
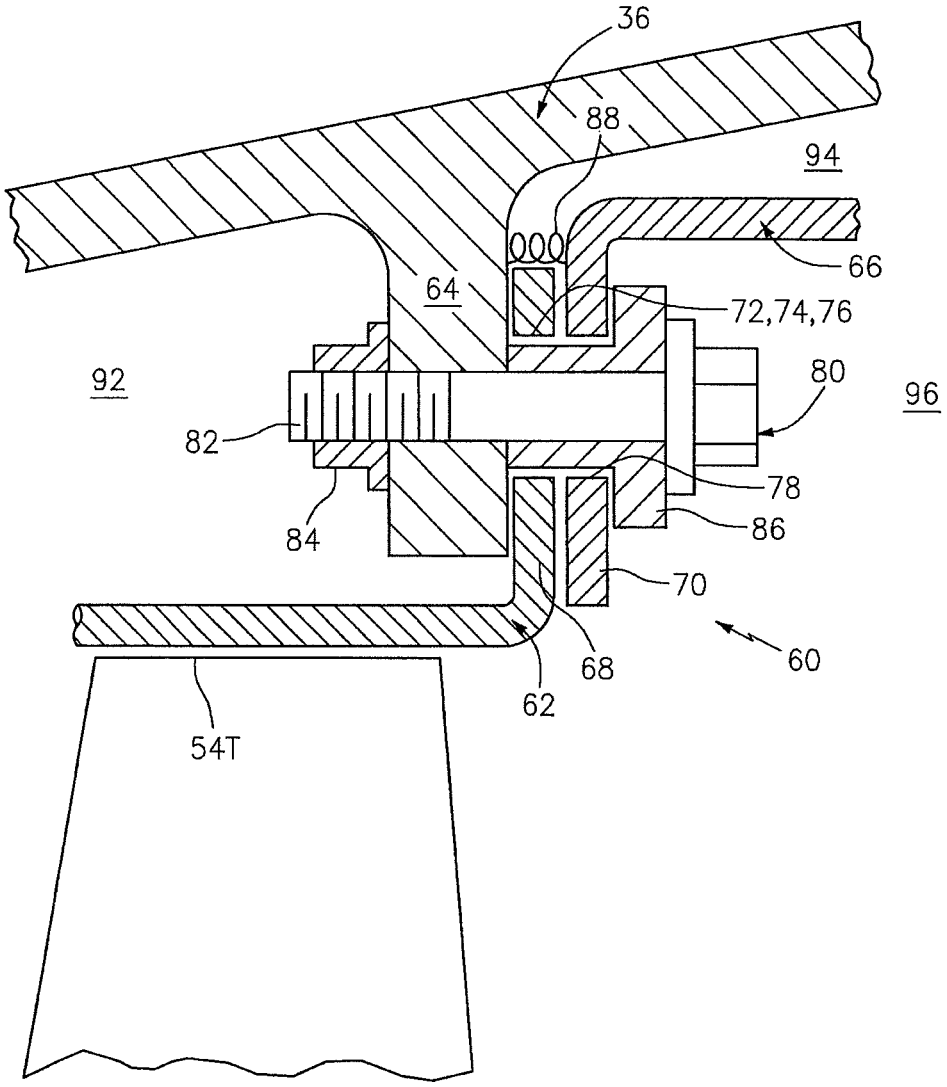
FIG. 2 is an expanded cross-section view of an interface within the gas turbine engine according to one disclosed non-limiting embodiment.

With reference to FIG. 2, the engine 20 includes an interface 60 disposed in an annulus radially between the engine case structure 36 and airfoil tips 54T of, for example, the HPT 54 to provide an effective, thermally accomodatable outer gas path boundary for the core airflow. The interface 60 in the disclosed non-limiting embodiment is a circumferential face interface within the engine case structure 36.

The interface 60 generally includes a multiple of segmented components 62, a case flange 64 and a full ring component 66. Each of the multiple of segmented components 62 such as Blade Outer Air Seal (BOAS) segments includes a segment flange 68. The segment flange 68 abuts in facial engagement with the case flange 64 and a ring flange 70 of the full ring component 66 such as a full ring seal support, a Blade Outer Air Seal (BOAS) support, a seal support or other flow discourager.

Figure 3:
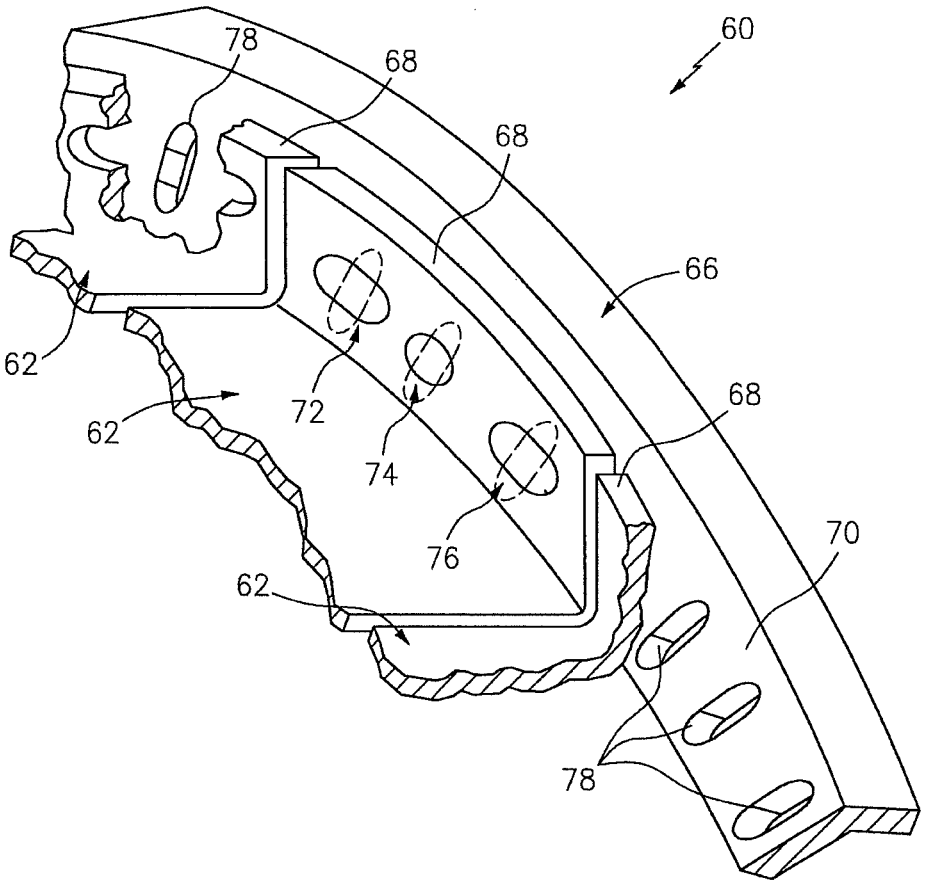
FIG. 3 is a partial perspective view of the interface.

Each of the multiple of segmented components 62 includes three apertures 72, 74, 76 through the segment flange 68 (also shown in FIG. 3). The apertures 72, 74, 76 in the disclosed non-limiting embodiment include a slot aperture 72, a circular aperture 74 and a slot aperture 76. The ring flange 70 of the full ring component 66 includes a multiple of slot apertures 78 (also shown in FIG. 3). The slot apertures 72, 76 are transverse to the slot apertures 78. In the disclosed non-limiting embodiment the slot apertures 72, 76 are arranged circumferentially, while the slot apertures 78 are arranged radially with respect to the engine axis A. The circular aperture 74 operates to locate each of the multiple of segmented components 62 with respect to the full ring component 66.

Each of the apertures 72, 74, 76, 78 receive a fastener assembly 80. The fastener assembly 80 generally includes a bolt 82, a nut 84 and a flanged bushing 86. The flanged bushing 86 is received within the apertures 72, 74, 76, 78 to mount each of the multiple of segmented components 62 to the full ring component 66. The flanged bushing 86 abuts the case flange 64 and extends through the segment flange 68 and the ring flange 70.

Each of the multiple of segmented components 62 remain fixed in the radial direction to maintain precise interaction with the passing blade tips 54T and are anti-rotated to prevent translation in the circumferential direction by the fastener assemblies 80. The slot apertures 72, 76 78 permit each of the multiple of segmented components 62 to grow radially due to thermal expansion. Although the fastener assembly 80 may be tightly fastened, the flanged bushing 86 leaves the multiple of segmented components 62 and the full ring component 66 free to slide along the flanged bushing 86.

A seal 88 such as a W-seal may be located between the ring flange 70 and the case flange 64 to further segregate the pressures within a first plenum 92, a second plenum 94 and a third plenum 96. The pressure within the first plenum 92 is greater than the pressure in the second plenum 94 which is greater than the pressure within the third plenum 96. The pressure in the first plenum 92 forces the multiple of segmented components 62 and the full ring component 66 against the flanged bushing 86. The pressure also forces the machined surfaces of the flanges 68, 70 together to further reduce the leakage through this interface. The seal 88 interacts with the two full ring components—the case flange 64 and the ring flange 70—to reduce the leakage from the second plenum 94 to the first plenum 92 and the third plenum 96.

The interface 60 thereby effectively maintains an outer gas path boundary for the core airflow even as the components 62, 66 thermally cycle. The interface 60 provides full ring support, permits the segmented components 62 to cycle circumferentially and the full ring component 66 to cycle radially and circumferentially, yet the radial position of the segmented components 62 are precisely held.

Figure 4:
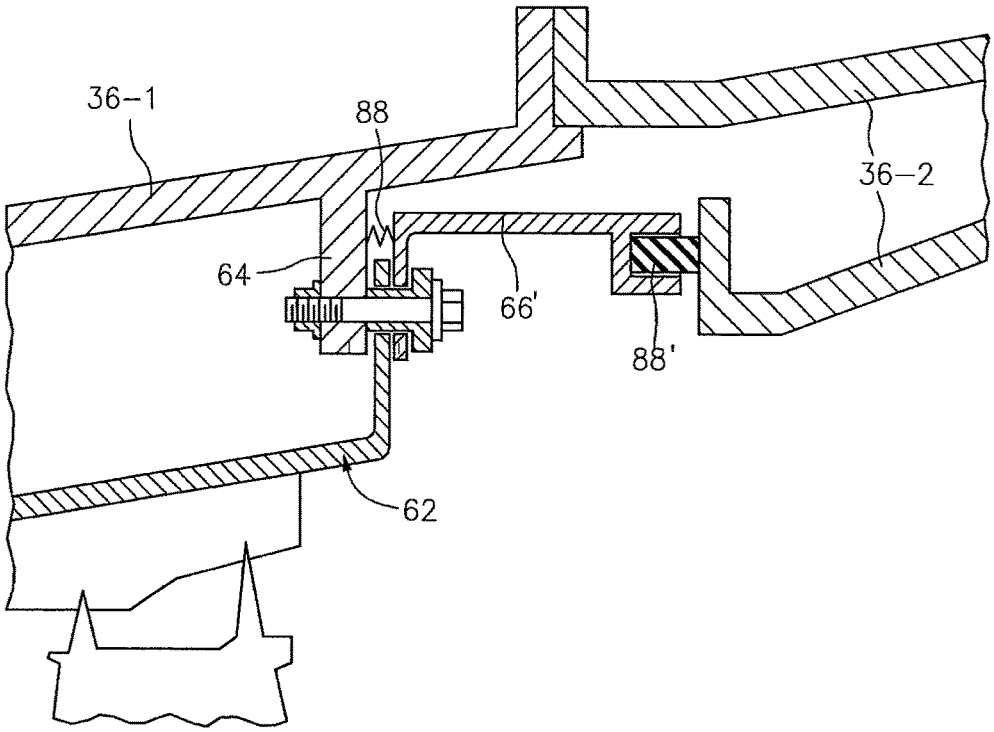
FIG. 4 is an expanded cross-section view of an interface within the gas turbine engine according to another disclosed non-limiting embodiment.

With reference to FIG. 4, a full ring component 66' may alternatively be utilized between a first engine case structure 36-1 and a second engine case structure 36-2. That is, a seal 88' may alternatively be located between the full ring component 66' and the second engine case structure 36-2. The seal 88' facilitates radial and axial displacement of the engine case structures 36-1, 36-2 in response to thermal cycling.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. An interface within a gas turbine engine, comprising:

a multiple of segmented components, each with a segment flange with a multiple of segment apertures, at least one of said multiple of segment apertures includes a first slot aperture; and a full ring component with a ring flange that defines a multiple of ring apertures, at least one of said multiple of ring apertures includes a second slot aperture, said second slot aperture transverse to said first slot aperture.

2. The interface as recited in claim 1, wherein said second slot aperture is perpendicular to said first slot aperture.

3. The interface as recited in claim 1, wherein said first slot aperture is circumferentially oriented.

4. The interface as recited in claim 1, wherein said second slot aperture is radially oriented.

5. The interface as recited in claim 1, wherein said first slot aperture is circumferentially oriented and said second slot aperture is radially oriented.

6. The interface as recited in claim 1, wherein each of said multiple of segmented components are Blade Outer Air Seal (BOAS) segments.

7. The interface as recited in claim 1, wherein said full ring component is a full ring seal support.

8. The interface as recited in claim 1, further comprising a case flange adjacent to said segment flange of each of said multiple of segmented components.

9. The interface as recited in claim 8, further comprising a multiple of fastener assemblies mounted through said case flange, said multiple of segment apertures and said multiple of ring apertures.

10. The interface as recited in claim 9, wherein each of said multiple of fastener assemblies include a flanged bushing that abuts said case flange and extends through said ring flange and said segment flange.

11. A Blade Outer Air Seal (BOAS) assembly within a gas turbine engine, comprising:

a multiple of Blade Outer Air Seal (BOAS) segments, each with a segment flange with a multiple of segment apertures, at least one of said multiple of segment apertures includes a first slot aperture; and a full ring seal support with a ring flange that defines a multiple of ring apertures, at least one of said multiple of ring apertures includes a second slot aperture, said second slot aperture transverse to said first slot aperture.

12. The interface as recited in claim 11, wherein said multiple of segment apertures includes a circular aperture.

13. The interface as recited in claim 11, wherein said multiple of segment apertures defines a slot aperture, circular aperture, slot aperture sequence.

14. The interface as recited in claim 13, wherein said circular aperture is circumferentially centrally located in said segment flange.

15. The interface as recited in claim 11, wherein said first slot aperture is circumferentially oriented and said second slot aperture is radially oriented.

16. The interface as recited in claim 11, further comprising a case flange adjacent to said segment flange of each of said multiple of segmented components.

17. The interface as recited in claim 16, further comprising a multiple of fastener assemblies mounted through said case flange, said multiple of segment apertures and said multiple of ring apertures.

18. The interface as recited in claim 17, wherein each of said multiple of fastener assemblies include a flanged bushing that abuts said case flange and extends through said ring flange and said segment flange.

19. A method of mounting a Blade Outer Air Seal (BOAS) segment within a gas turbine engine, comprising:

mounting a fastener assembly through a first slot aperture in a segment flange of a Blade Outer Air Seal (BOAS)

segment, the first slot aperture transverse to a second slot aperture in a ring flange of a full ring seal support.

20. The method as recited in claim 19, further comprising locating a flanged bushing of the fastener assembly through the first slot aperture and the second slot aperture to abut a case flange.

* * * * *